US008256863B2

(12) United States Patent
Nishida

(10) Patent No.: US 8,256,863 B2
(45) Date of Patent: Sep. 4, 2012

(54) INK-JET PRINTER

(75) Inventor: Katsunori Nishida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 273 days.

(21) Appl. No.: 12/726,755

(22) Filed: Mar. 18, 2010

(65) Prior Publication Data

US 2010/0245436 A1 Sep. 30, 2010

(30) Foreign Application Priority Data

Mar. 27, 2009 (JP) ..... 2009-078269

(51) Int. Cl.
*B41J 29/38* (2006.01)

(52) U.S. Cl. ..... 347/14

(58) Field of Classification Search ..... None
See application file for complete search history.

(56) References Cited

U.S. PATENT DOCUMENTS

| | | | | |
|---|---|---|---|---|
| 5,900,888 | A * | 5/1999 | Kurosawa | 347/7 |
| 6,193,355 | B1 | 2/2001 | Nakamura | |
| 2002/0097292 | A1 | 7/2002 | Saijo et al. | |
| 2007/0257954 | A1* | 11/2007 | Nishizaka et al. | 347/14 |
| 2007/0291072 | A1 | 12/2007 | Furukawa | |
| 2008/0266336 | A1 | 10/2008 | Maru et al. | |
| 2009/0021564 | A1 | 1/2009 | Seino et al. | |

FOREIGN PATENT DOCUMENTS

| | | |
|---|---|---|
| EP | 0525988 | 2/1993 |
| JP | 1-115637 | 5/1989 |
| JP | 5-16391 | 1/1993 |
| JP | 10-58761 | 3/1998 |
| JP | 2002-283590 | 10/2002 |
| JP | 2006-205747 | 8/2006 |
| JP | 2008-023988 | 2/2008 |
| JP | 2008-132598 | 6/2008 |
| JP | 2008-290451 | 12/2008 |
| JP | 2009-45916 | 3/2009 |
| JP | 2010-228287 | 10/2010 |

* cited by examiner

*Primary Examiner* — Stephen Meier
*Assistant Examiner* — Tracey McMillion
(74) *Attorney, Agent, or Firm* — Frommer Lawrence & Haug LLP

(57) ABSTRACT

An ink-jet printer has an ink-jet head which discharges an ink from nozzles, and an ink supply passage through which the ink is supplied to the ink-jet head. The ink-jet head and the ink supply passage are filled with an initial ink, which is of a same type as that of the ink to be discharged from the nozzles, upon shipping of the ink-jet printer. The ink-jet printer includes a purge mechanism which executes a purge process to forcibly discharge the ink in the ink-jet head and the ink supply passage from the nozzles; an input section which accepts an input from a user; an initial ink detecting section which detects whether or not the initial ink remains in the ink-jet head and the ink supply passage; and a controller which controls the purge mechanism and the input section based on a detecting result of the initial ink detecting section.

8 Claims, 10 Drawing Sheets

INK-JET PRINTER

CROSS REFERENCE TO RELATED APPLICATION

The present application claims priority from Japanese Paten Application No. 2009-078269, filed on Mar. 27, 2009, the disclosure of which is incorporated herein by reference in its entirety.

BACKGROUND OF THE INVENTION

1. Field of the Invention

The present invention relates to an ink-jet printer which performs the printing by discharging an ink from nozzles.

2. Description of the Related Art

In an ink-jet recording apparatus described in U.S. Pat. No. 6,193,355 B1 (corresponding to Japanese Patent Application Laid-open No. 2006-205747), a liquid for preservation, which is prepared by removing components of the dye and the pigment from an ink, is charged into a recording head when the ink-jet printer is shipped from a factory. Upon the first time start-up, an initial purge is performed to suck the liquid or solution contained in the recording head from nozzles. Accordingly, the storage solution contained in the recording head is discharged, and the ink is introduced from an ink cartridge into the recording head.

If the air exists in the recording head, the air consequently remains without being discharged from the recording head when the ink is introduced into the recording head, and the air causes a factor of the discharge failure of the ink. However, in the case of the ink-jet recording apparatus described in U.S. Pat. No. 6,193,355 B1, the interior of the recording head is filled with the liquid for preservation upon the shipping, and the air does not exist in the interior. Therefore, when the ink is introduced from the ink cartridge into the recording head, the air does not remain in the recording head.

The liquid, which is charged into the recording head upon the production, is not limited to the exclusive storage solution as described in U.S. Pat. No. 6,193,355 B1. For example, the liquid may be any ink of the same type as that of the ink to be discharged from the nozzles. When the ink (initial ink) is charged into the recording head upon the shipping, it is also conceived that the printing is performed by using the initial ink.

However, when the ink-jet recording apparatus is filled with the initial ink upon the shipping as described above, then the gas enters the initial ink in some cases and the viscosity of the initial ink increases in other cases due to the change of the environment including, for example, the temperature and the pressure during a period from the shipping of the ink-jet recording apparatus to the first time start-up. In such a situation, if it is intended to perform the printing by using the initial ink, for example, it is feared that the failure may arise in the discharge of the ink from the nozzles and/or the bending may arise in the ink discharge direction. It is feared that any required printing quality cannot be realized.

In view of the above, the following procedure is conceived. That is, the initial purge is performed to completely discharge the initial ink in the same manner as in the case in which the storage solution is charged into the recording head as described above. The printing is performed after the ink is newly introduced into the recording head. However, if the initial ink is uniformly discharged by the initial purge, the initial ink is discharged even when the gas does not exist in the initial ink and the viscosity of the initial ink is not increased. The initial ink, which can be utilized for the printing, is uselessly discharged.

SUMMARY OF THE INVENTION

An object of the present invention is to provide an ink-jet printer which is capable of effectively utilizing the initial ink and which makes it possible to realize a required printing quality.

According to a first aspect of the present teaching, there is provided an ink-jet printer provided with an ink-jet head which discharges an ink from a plurality of nozzles and an ink supply passage which is connected to the ink-jet head and through which the ink is supplied to the ink-jet head, the ink-jet head and the ink supply passage being filled with an initial ink, which is of a same type as that of the ink to be discharged from the nozzles, upon shipping of the ink-jet printer, the ink-jet printer including: a purge mechanism which executes a purge process to forcibly discharge the ink in the ink-jet head and the ink supply passage from the nozzles; an input section which accepts an input with respect to the purge process from a user; an initial ink detecting section which detects whether or not the initial ink remains in the ink-jet head and the ink supply passage; and a controller which controls the purge mechanism and the input section based on a detection result of the initial ink detecting section.

According to the first aspect of the present teaching, the purge mechanism and the input section are controlled based on the detection result of the initial ink detecting section, it is possible to effectively utilize the initial ink without discharging unnecessarily.

On the other hand, since it is possible to reliably discharge the initial ink in which the gas entered and/or the viscosity is increased, it is possible to realize the required printing quality.

DESCRIPTION OF THE PREFERRED EMBODIMENTS

A preferred embodiment of the present invention will be explained below.

Figure 1:
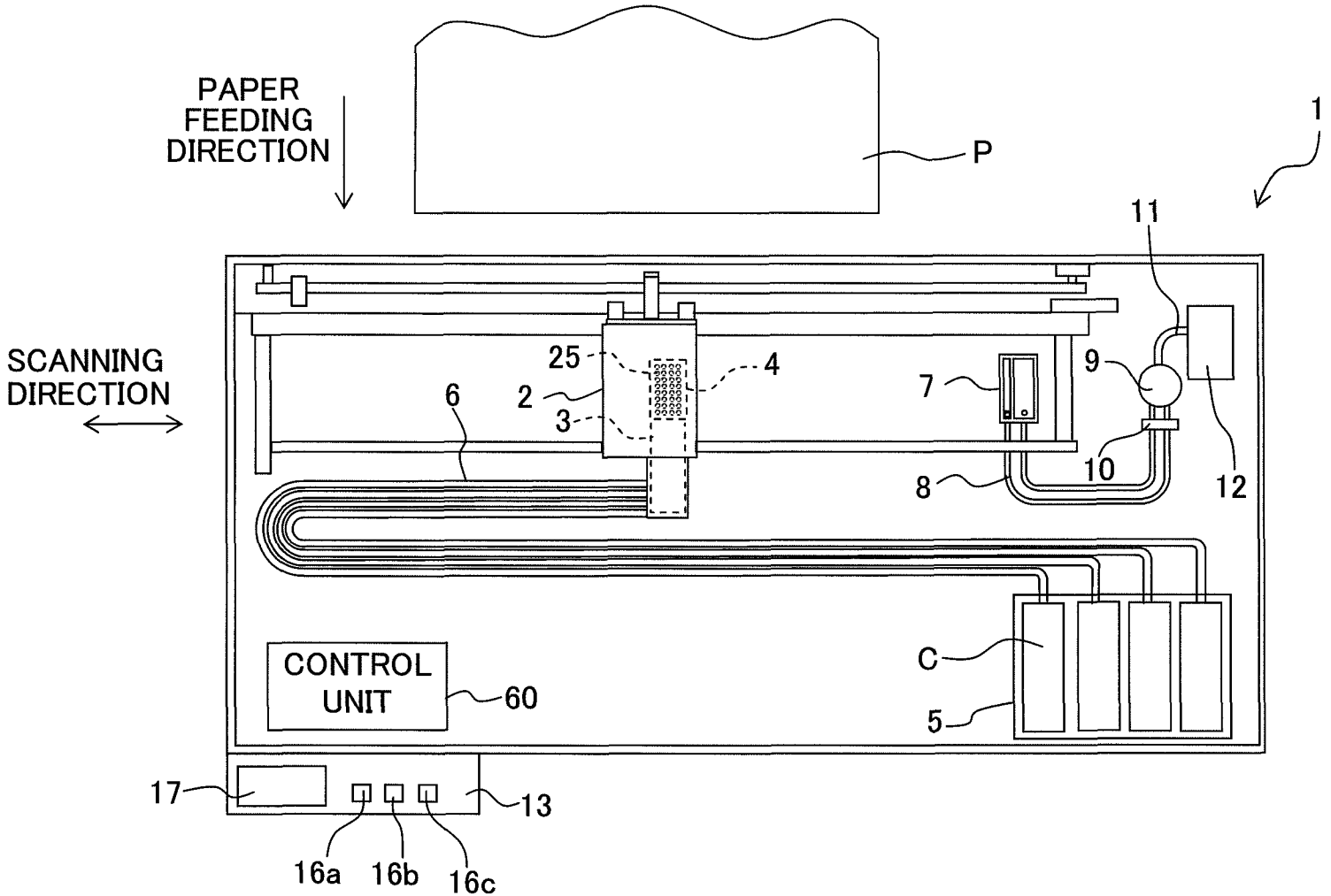
FIG. 1 shows a schematic arrangement of a printer in an embodiment of the present invention.

As shown in FIG. 1, an ink-jet printer 1 includes, for example, a carriage 2, subtanks 3, an ink-jet head 4, a cartridge attachment section 5, four tubes 6, a suction cap 7, two tubes 8, a suction pump 9 (purge mechanism), a switching unit 10, a tube 11, a waste ink tank 12, and an input unit 13 (input section). The operation of the ink-jet printer 1 is controlled by a control unit 60.

The carriage 2 is reciprocatively movable in the scanning direction (left-right direction as shown in FIG. 1). The subtanks 3 are attached to the carriage 2. The ink-jet head 4 is provided on the lower surfaces of the subtanks 4. Four color inks of black, yellow, cyan, and magenta are supplied from the subtanks 3. Further, the ink-jet head 4 discharges the four color inks from nozzles 25 formed on the lower surface thereof.

The cartridge attachment section 5 is arranged approximately at a lower-right end portion of the ink-jet printer 1 as viewed in FIG. 1. Four ink cartridges C, in which the inks of black, yellow, cyan, and magenta are stored respectively, can be attached/detached with respect to the cartridge attachment section 5. The four tubes 6 connect the subtanks 3 and the four ink cartridges C attached to the cartridge attachment section 5. The inks, which are stored in the ink cartridges C, are supplied via the tubes 6 to the subtanks 3 and the ink-jet head 4.

In this embodiment, the components, which are provided by combining the subtanks 3 and the four tubes 6 described above, correspond to the ink supply flow passages according to the present invention. The inks (initial inks), which are of the same types as those of the inks to be discharged, are charged into the ink-jet head 4, the subtanks 3, and the tubes 6 upon the production of the ink-jet printer 1. The ink-jet printer 1 is shipped in this state. In other words, the ink-jet head 4, the subtanks 3, and the tubes 6 are filled with the initial inks in the state in which the ink-jet printer 1 is unused.

In the ink-jet printer 1, the printing is performed on the recording paper P such that the inks are discharged, from the ink-jet head 4 which is reciprocatively moved in the scanning direction together with the carriage 2, onto the recording paper P which is transported in the downward direction (paper feeding direction) as viewed in FIG. 1 by an unillustrated printing paper transport mechanism.

The suction cap 7 is arranged at the position to be opposed to the ink-jet head 4 in a state in which the carriage 2 is moved to the most rightward position as viewed in FIG. 1. The suction cap 7 is constructed movably in the upward-downward direction (direction perpendicular to the paper surface as viewed in FIG. 1). When the suction cap 7 is moved in the upward direction in the state in which the carriage 2 is disposed at the concerning position, it is possible to distinctly cover the nozzles 25 for discharging the black ink and the nozzles 25 for discharging the color inks (yellow, cyan, and magenta) as described later on.

The suction pump 9 is connected via the two tubes 8 to a portion of the suction cap 7 which coveres the nozzles 25 for discharging the black ink and a portion of the suction cap 7 which coveres the nozzles 25 for discharging the color inks respectively. The switching unit 10 is provided at intermediate portions of the tubes 8. The switching unit 10 is constructed so that the switching unit 10 can individually switch or changeover the connection and the disconnection between the suction pump 9 and the two portions of the suction cap 7 described above. The waste ink tank 12 is connected to the suction pump 9 via the tube 11.

In the ink-jet printer 1, the inks can be sucked from the nozzles 25 by driving the suction pump 9 in the state in which the plurality of nozzles 25 are covered with the suction cap 7 as described above so that the purge process is performed to discharge the inks from the interiors of the ink-jet head 4, the subtanks 3, and the tubes 6. In this situation, when the changeover is effected by the switching unit 10, it is possible to selectively suck the ink or inks from the nozzles 25 for discharging the black ink and the nozzles 25 for discharging the color inks. The discharged inks are stored in the waste ink tank 12.

The input unit 13 is provided at a lower-left end portion of the ink-jet printer 1 as shown in FIG. 1. The input unit 13 is the unit or device which is provided in order that the user performs the operation in relation to the ink-jet printer 1 including, for example, the purge process request or selection of a purge process type. The input unit 13 is provided with three buttons 16*a* to 16*c* and a display 17. The buttons 16*a* to 16*c* are operated, for example, when the user inputs the purge process type or the purge process request as described later on. The display 17 displays, for example, the presentation of the functions provided for the three buttons 16*a* to 16*c*.

Figure 4:
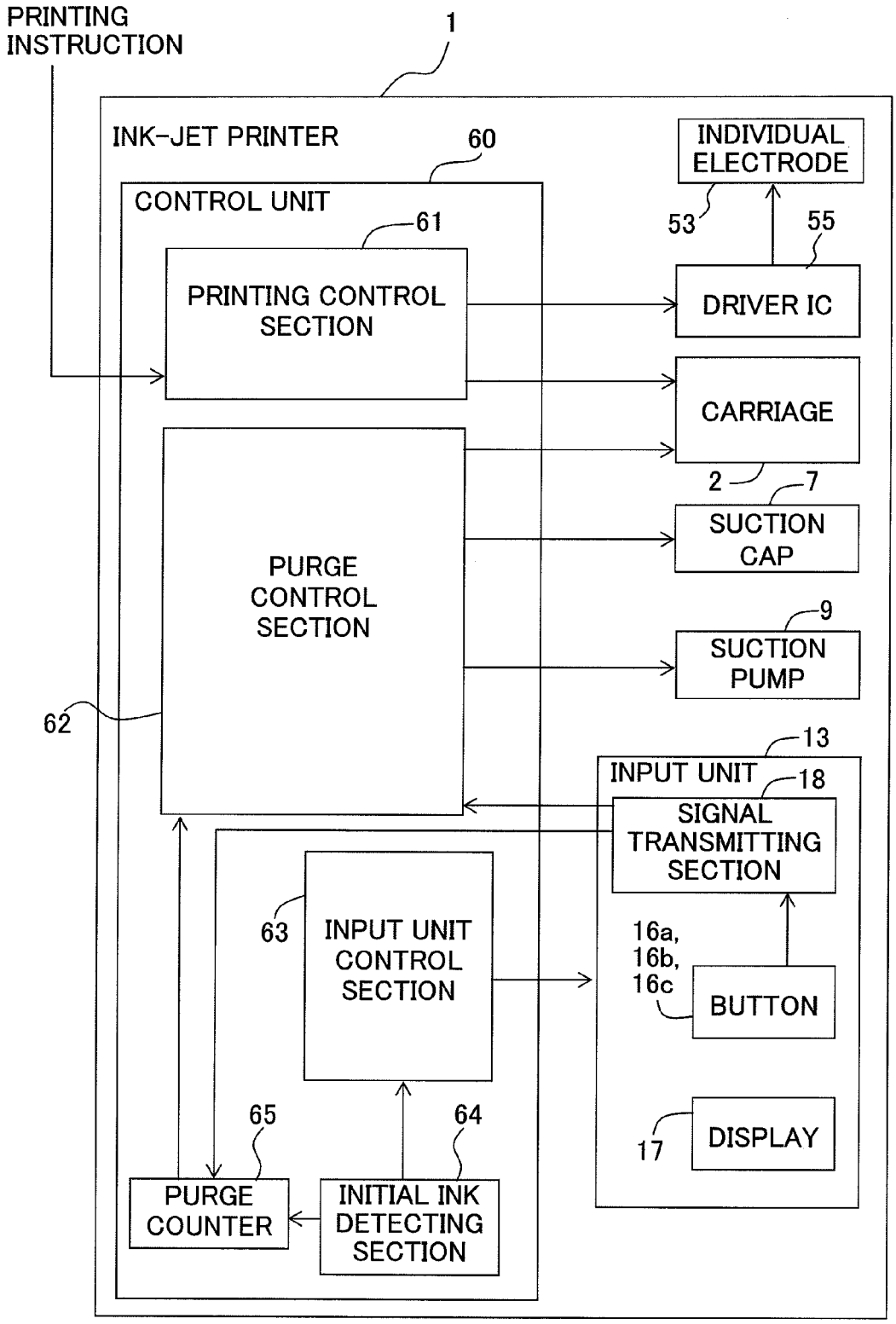
FIG. 4 shows a functional block diagram of a control unit shown in FIG. 1.

Other than the above, the input unit 13 is provided with a signal transmitting section 18 therein (see FIG. 4). When the buttons 16*a* to 16*c* are operated by the user, the signal transmitting section 18 outputs, to the control unit 60, a signal to instruct the execution of the operation corresponding to the operation of each of the buttons 16*a* to 16*c* as described later on.

Figure 2:
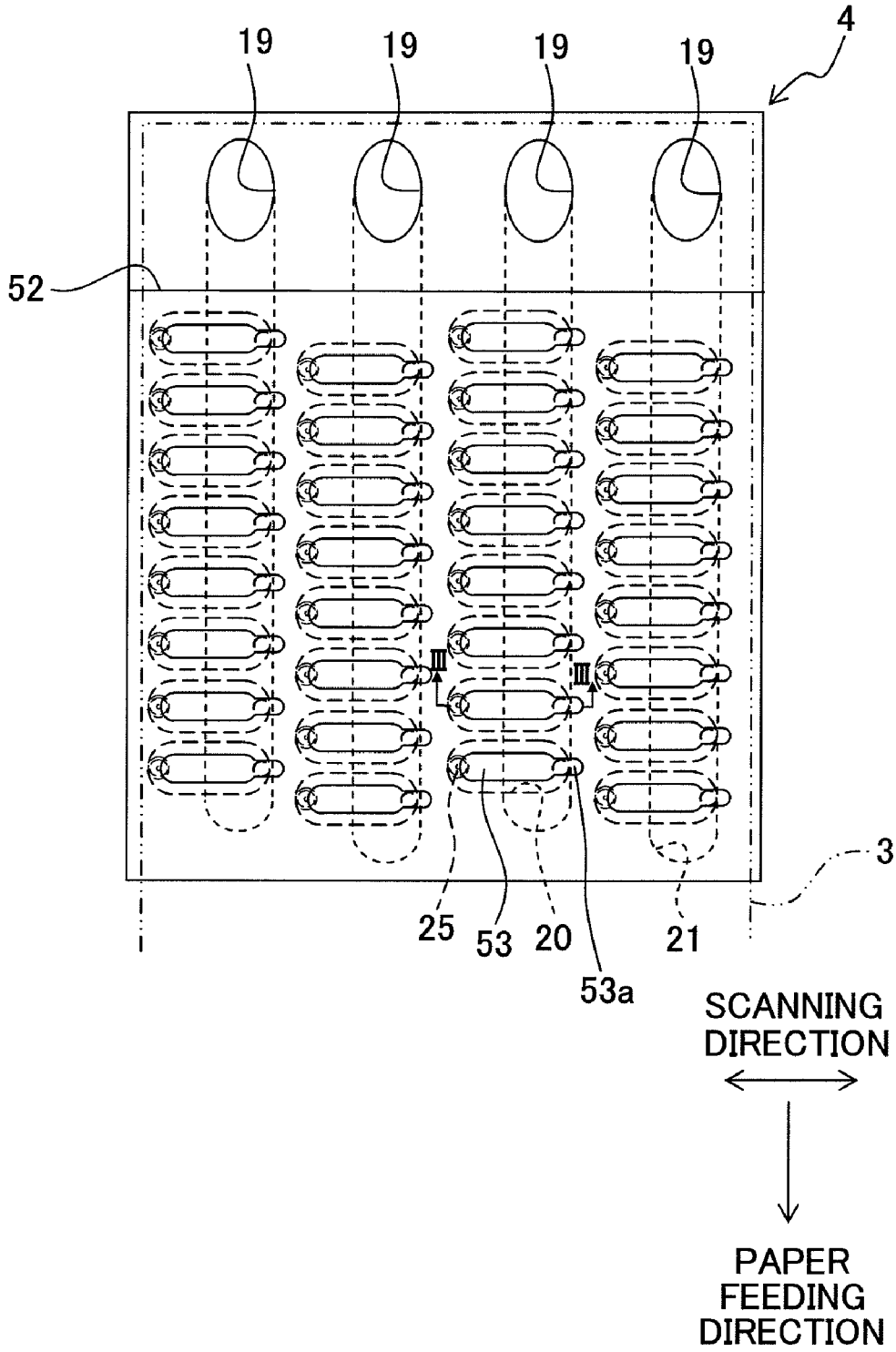
FIG. 2 shows a plan view illustrating an ink-jet head shown in FIG. 1.
Figure 3:
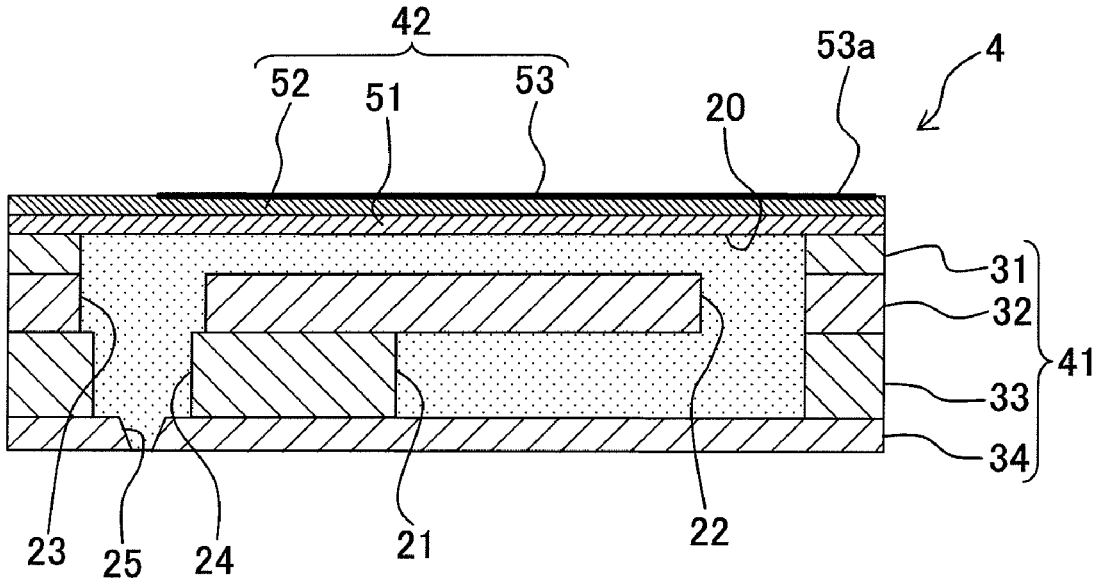
FIG. 3 shows a sectional view taken along a line shown in FIG. 2.

Next, the ink-jet head 4 will be explained. As shown in FIGS. 2 and 3, the ink-jet head 4 is provided with a flow passage unit 41 which is formed with the ink flow passages including pressure chambers 20 and the nozzles 25, and a piezoelectric actuator 42 which is provided to apply the pressure to the inks contained in the pressure chambers 20.

The flow passage unit 41 is constructed by mutually stacking four plates of a cavity plate 31, a base plate 32, a manifold plate 33, and a nozzle plate 34. The three plates 31 to 33 except for the nozzle plate 34, which are included in the four plates 31 to 34, are composed of a metal material such as stainless steel or the like, and the nozzle plate 34 is composed of a synthetic resin material such as polyimide or the like. Alternatively, the nozzle plate 34 may be also composed of a metal material in the same manner as the other three plates 31 to 33.

The plurality of pressure chambers 20 are formed for the cavity plate 31. Each of the pressure chambers 20 has a substantially elliptical shape in which the scanning direction is the longitudinal direction as viewed in a plan view. The plurality of pressure chambers 20 are arranged in the paper feeding direction to form one array of the pressure chambers 20. Further, the arrays of the pressure chambers 20 as described above are arranged in four arrays in the scanning direction. A plurality of through-holes 22, 23, each of which is substantially circular, are formed at portions of the base plate 32 opposed to the both end portions of the plurality of pressure chambers 20 in relation to the longitudinal direction as viewed in a plan view.

Manifold flow passages 21 are formed for the manifold plate 33. The manifold flow passages 21 are provided corresponding to the four arrays of the pressure chambers 20 described above. Each of the manifold flow passages 21 extends in the paper feeding direction to be opposed to substantially right halves of the plurality of pressure chambers 20 for constructing each of the arrays of the pressure chambers 20. The inks are supplied to the manifold flow passages 21 from four ink supply ports 19 which are formed at end portions disposed on the upstream side in the paper feeding direction and which are connected to the subtanks 3. In particular, the inks of black, yellow, cyan, and magenta are supplied from the four ink supply ports 19 as referred to in this order starting from one arranged on the left side as shown in FIG. 2.

A plurality of substantially circular through-holes 24 are formed at portions of the manifold plate 33 opposed to the plurality of through-holes 23 as viewed in a plan view. The plurality of nozzles 25 are formed at portions of the nozzle plate 34 opposed to the through-holes 24 as viewed in a plan view. The plurality of nozzles 25 are arranged in the paper feeding direction to form one nozzle array thereby in the same manner as the pressure chambers 20. Further, the nozzle arrays as described above are arranged in four arrays in the scanning direction. The inks of black, yellow, cyan, and magenta are discharged from the plurality of nozzles 25 as referred to in this order starting from those which construct the nozzle array disposed on the left side as shown in FIG. 2.

In the flow passage unit 41, the manifold flow passages 21 are communicated with the pressure chambers 20 via the through-holes 22. Further, the pressure chambers 20 are communicated with the nozzles 25 via the through-holes 23, 24. In this way, the flow passage unit 41 is formed with the plurality of individual ink flow passages which extend from the manifold flow passages 21 via the pressure chambers 20 to arrive at the nozzles 25.

The piezoelectric actuator 42 is provided with a vibration plate 51, a piezoelectric layer 52, and a plurality of individual electrodes 53. The vibration plate 51 is composed of a metal material such as stainless steel or the like. The vibration plate 51 is joined to the upper surface of the flow passage unit 41 so that the plurality of pressure chambers 20 are covered therewith. The conductive vibration plate 51 also functions as a common electrode in order to drive the piezoelectric actuator 42 as described later on. The vibration plate 51 is always retained at the ground electric potential.

The piezoelectric layer 52 is composed of a piezoelectric material containing a main component of lead titanium zirconate which is a mixed crystal of lead titanate and lead zirconate. The piezoelectric layer 52 is arranged continuously to range over the plurality of pressure chambers 20 on the upper surface of the vibration plate 51.

The plurality of individual electrodes 53 have substantially elliptical shapes which are one size smaller than those of the pressure chambers 20 as viewed in a plan view. The plurality of individual electrodes 53 are arranged respectively at portions opposed to the substantially central portions of the plurality of pressure chambers 20 on the upper surface of the piezoelectric layer 52. End portions of the respective individual electrodes 53, which are disposed on the side opposite to the nozzles 25 in relation to the longitudinal direction, extend to portions not opposed to the pressure chambers 20. Forward end portions thereof are connecting terminals 53*a*. The connecting terminals 53*a* are connected to driver IC 55 (see FIG. 6) via an unillustrated flexible wiring member (FPC). The driving electric potential is individually applied to each of the individual electrodes 53 by the driver IC 55.

Portions of the piezoelectric layer 52 described above, which are interposed between the plurality of individual electrodes 53 and the vibration plate 51 as the common electrode, are polarized in the thickness direction thereof.

An explanation will now be made about a method for driving the piezoelectric actuator 42. In the piezoelectric actuator 42, the plurality of individual electrodes 53 are previously retained at the ground electric potential by the driver IC 55. When the driving electric potential is applied to any one of the plurality of individual electrodes 53 by the driver IC 55, then the electric potential difference appears between the concerning individual electrode 53 and the vibration plate 51 as the common electrode which is retained at the ground electric potential, and the electric field, which is in the thickness direction that is the same as the polarization direction, is generated at the portion of the piezoelectric layer 52 interposed between the electrodes. Accordingly, the concerning portion of the piezoelectric layer 52 is shrunk in the horizontal direction perpendicular to the thickness direction. As a result, the vibration plate 51 and the piezoelectric layer 52 are deformed so that they are convex toward the pressure chamber 20 as a whole, and the volume of the pressure chamber 20 is decreased. Accordingly, the pressure of the ink contained in the pressure chamber 20 is raised, and the ink is discharged from the nozzle 25 communicated with the pressure chamber 20.

Next, an explanation will be made about the control unit 60 which controls the operation of the ink-jet printer 1. The control unit 60 includes, for example, CPU (Central Processing Unit), ROM (Read Only Memory), and RAM (Random Access Memory). As shown in FIG. 4, these components function, for example, as a printing control section 61, a purge control section 62, an input unit control section 63, an initial ink detecting section 64, and a purge counter 65.

The printing control section 61 controls the operations of the carriage 2 and the driver IC 55 (ink-jet head 4) when the printing is performed in the ink-jet printer 1. The purge control section 62 controls the operations of the carriage 2, the suction cap 7, and the suction pump 9 when the purge process is performed in the ink-jet printer 1. Specifically, as for the purge process described above, the purge control section 62 selectively allows the execution of any one of the three types of purge processes in which the ink discharge amounts (degrees of ink discharge) are different from each other (referred to as "strong purge", "middle purge", and "weak purge" in an order starting from one having a large ink discharge amount) by changing, for example, the number of revolutions of the suction pump 9. The purge control section 62 performs the control for the purge process described above depending on the inputted signal when the signal is inputted from the signal transmitting section 18.

The input unit control section 63 controls the operation of the input unit 13, when the functions including, for example the request for the purge process are allotted to the buttons 16*a* to 16*c* and when the allotment is displayed on the display 17 as described later on.

The initial ink detecting section 64 detects whether or not the initial inks remain in the ink-jet head 4, the subtanks 3, and the tubes 6, for example, on the basis of the amounts of consumption of the inks by the ink-jet head 4 and the ink remaining amounts of the ink cartridges C attached to the cartridge attachment section 5.

The purge counter 65 counts the number of the requests for the purge processes continuously inputted until the deterioration of the printing quality is dissolved after the initial ink detecting section 64 detects that the initial inks do not remain as described later on.

Figure 5A:
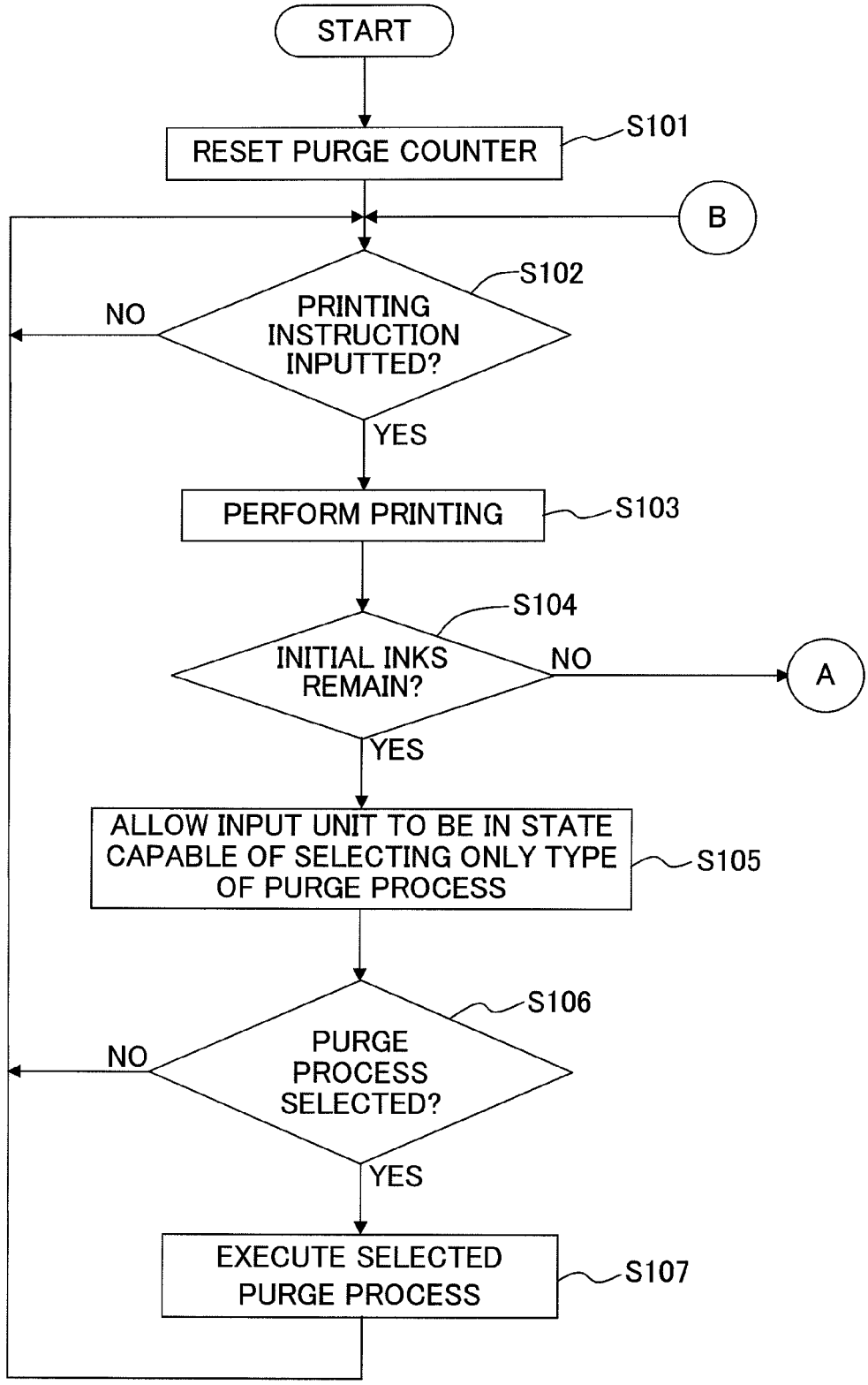
FIGS. 5A and 5B show a flow chart illustrating the operation of the printer.
Figure 5B:
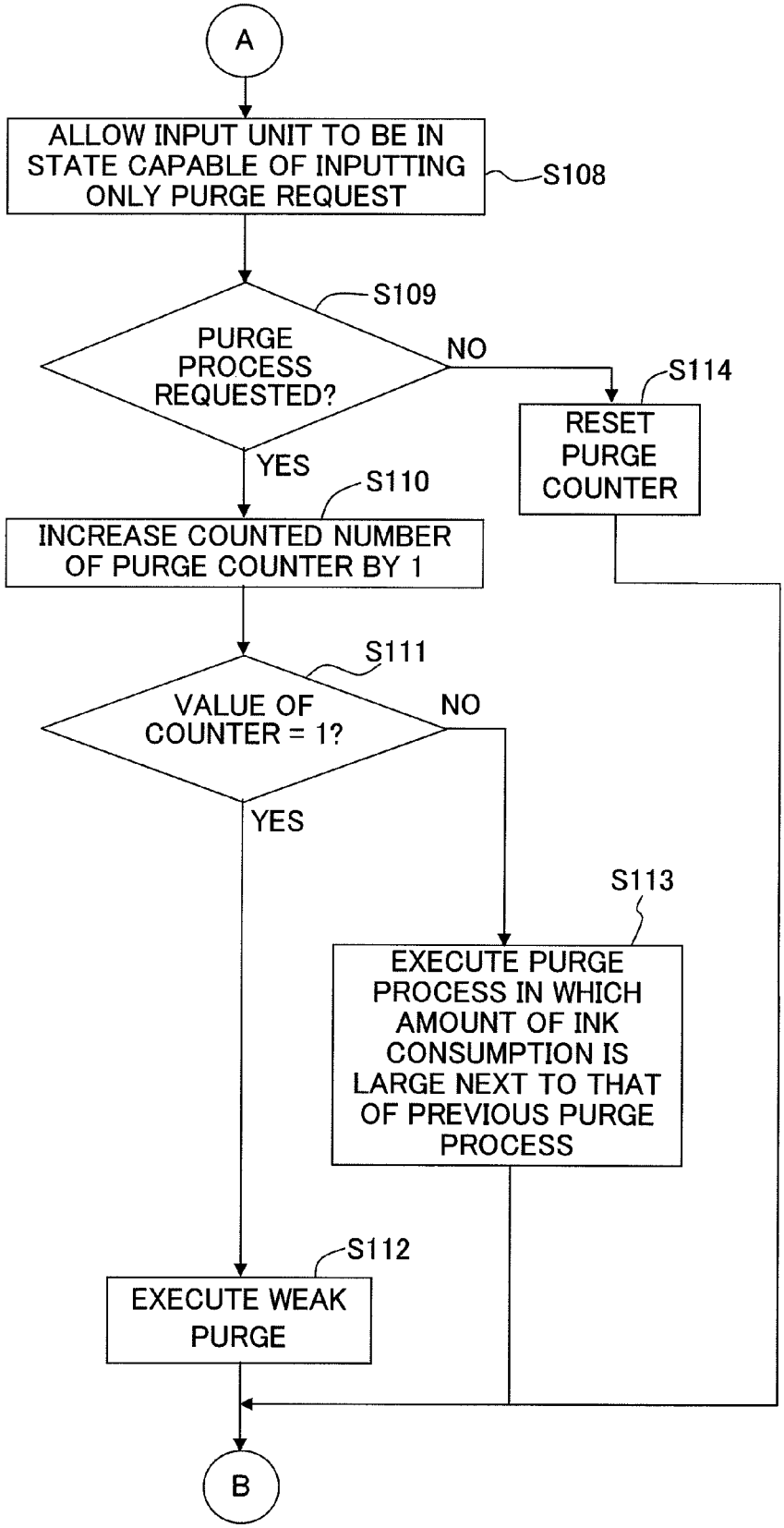

Next, an explanation will be made with reference to a flow chart shown in FIG. 5 about the operation of the ink-jet printer 1. This flow chart is started when the power source is turned on for the ink-jet printer 1.

When the power source of the ink-jet printer 1 is turned on, then the purge counter 65 is firstly reset, and the counted number thereof is made zero (Step S101, hereinafter simply referred to, for example, as "S101"). After that, the routine waits until the printing instruction is inputted from the outside, for example, from PC connected to the ink-jet printer 1 (S102: NO). If the printing instruction is inputted (S102: YES), the printing is executed in accordance with the control of the printing control unit 61 (S103).

Figure 8A:
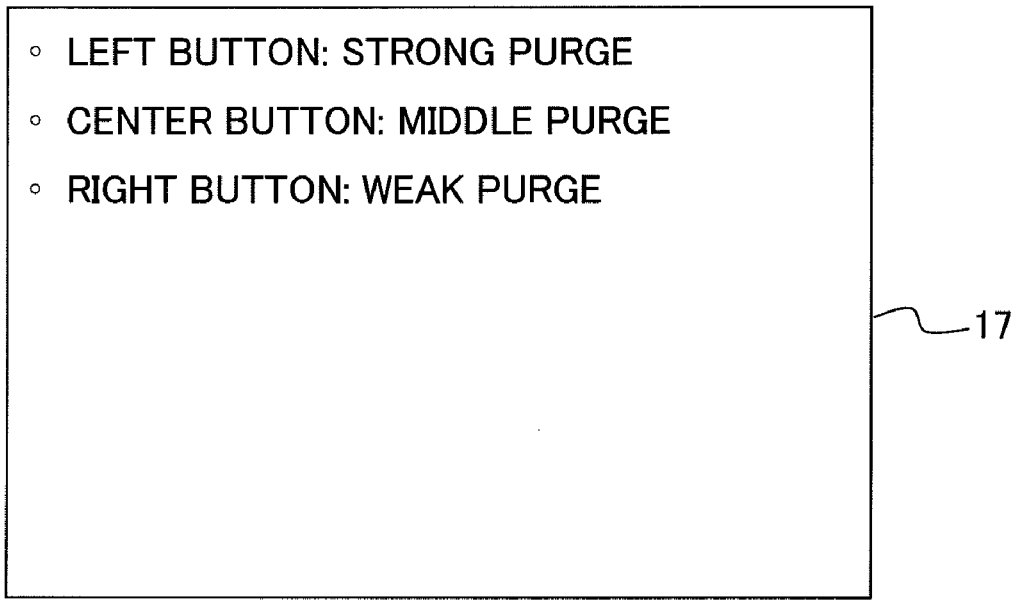
FIG. 8A shows an exemplary screen of a display according to the embodiment.

Subsequently, the initial ink detecting section 64 detects whether or not the initial inks remain in the ink-jet head 4, the subtanks 3, and the tubes 6 (S104). If it is detected that the initial inks remain (S104: YES), the buttons 16*a* to 16*c* are allotted for the inputs of the requests for the strong purge, the middle purge, and the weak purge respectively in accordance with the control of the input unit control section 63 to give a state in which the user can select the type of the purge. As shown in FIG. 8A, the allotment of the buttons 16*a* to 16*c* described above is displayed on the display 17 (S105).

Accordingly, the input unit 13 is in such a state that the input unit 13 can receive or accept only the requests for the purge processes of the three types described above in accordance with the operation of the buttons 16*a* to 16*c*. That is, the input unit control section 63 controls the input unit 13 so that the input unit 13 can accept an input of a purge process type selected from the three types of the purge processes of the strong purge, the middle purge, and the weak purge in which the degrees of the ink discharge are different from each other. Accordingly, only the purge process, which is included in the three types of the purge processes described above and which is selected by operating the buttons 16*a* to 16*c* by the user, is executable.

If the user observes the image printed in S103 described above and judges that the printing quality is deteriorated, the user operates any one of the buttons 16*a* to 16*c*. In general, the higher the degree of deterioration of the printing quality is, the larger the ink discharge amount is in the selected purge process.

If the type of the purge process is selected in accordance with the operation of the buttons 16*a* to 16*c* (S106: YES), the signal, which instructs the execution of the selected purge process, is transmitted from the signal transmitting section 18 to the purge control section 62. When the signal is inputted into the purge control section 62, the selected purge process is executed in accordance with the control of the purge control section 62 (S107). After that, the routine returns to S102 described above. If the input of the purge process type is not inputted (S106: NO), the routine returns to S102 described above as it is.

When the black-and-white or monochrome printing is executed in S103, the ink is sucked from the nozzles 25 for discharging the black ink in the purge process in S107 described above. When the color printing is executed, the inks are sucked from the nozzles 25 for discharging the color inks. The same procedure is also executed in the purge processes in S112 and S113 described later on.

In the ink-jet printer 1, the purge process in S107 described above is executed only in accordance with the input of the purge process type from the user in S106 described above during the period in which the initial ink detecting section 64 detects that the initial inks remain in S104 described above after the power source is firstly turned on. Therefore, the purge process, which has been hitherto performed automatically, for example, immediately after the ink cartridges C are attached to the cartridge attachment section 5 and when the state of no discharge of the inks from the ink-jet head 4 is continued for a predetermined period of time, is not executed.

On the other hand, if the initial ink detecting section 64 detects that the initial inks do not remain (S104: NO), all of the buttons 16*a* to 16*c* are allotted for an input of a purge process request in which the purge process type cannot be selected, in accordance with the control of the input unit control section 63. The allotment of the buttons 16*a* to 16*c* is displayed on the display 17 (S108).

Accordingly, the input unit 13 is in such a state that the input unit 13 can accept only the input of the purge process request in accordance with the operation of the buttons 16*a* to 16*c*. That is, the input unit control section 63 controls the input unit 13 so that the input unit 13 can adopt only the second input form in which only the input of the purge process request can be accepted. In other words, in the second input form, the type of the purge process can not be selected.

In this embodiment, all of the buttons 16*a* to 16*c* are allotted for the input of the requests for the purge processes. However, the present invention is not limited thereto. It is also allowable that only one or two of the buttons 16*a* to 16*d* is/are allotted for the input of the purge process request, and any function is not allotted for the remaining button or buttons.

If the user observes the image printed in S103 described above and judges that the printing quality is deteriorated, then the user operates any one of the buttons 16*a* to 16*c*, and thus the user inputs the request for the purge process.

If the request for the purge process is inputted in accordance with the operation of the buttons 16*a* to 16*c* (S109: YES), then a signal, which instructs the execution of the purge process, is transmitted from the signal transmitting section 18 to the purge control section 62, and a signal, which indicates that the instruction signal is inputted, is transmitted to the purge counter 65. When the purge counter 65 receives the signal, the purge counter 65 increases the counted number by 1 (S110). Subsequently, if the counted number of the purge counter 65 is 1, specifically if the inputted request for the purge process is the request for the first purge process (S111: YES), then the weak purge is executed in accordance with the control of the purge control section 62 (S112). After that, the routine returns to S102 described above.

On the other hand, if the counted number of the purge counter 65 is not less than 2, specifically if the deterioration of the printing quality is not dissolved by the previous purge process, and the request for the purge process is further inputted (S111: NO), then the purge process, in which the amount of ink discharge is large next to that of the previous purge process (i.e., the middle purge when the previous purge is the weak purge, or the strong purge when the previous purge is the middle purge), is executed in accordance with the control of the purge control section 62 (S113). After that, the routine returns to S102 described above. However, if the purge process, which has been previous executed, is the strong purge, the strong purge is executed again.

If the purge request is not inputted (S109: NO), then the purge counter 65 is reset, and the counted number is made zero (S114). After that, the routine returns to S102 described above.

In this context, in the ink-jet printer 1, the viscosity of the initial ink is increased in some cases and the gas enters the initial ink charged into the ink-jet head 4, the subtank 3, and the tube 6 upon the shipping in other cases, for example, due to the environmental change including the temperature and the humidity during the period in which the ink-jet printer 1 is firstly used after the shipping.

Therefore, the deterioration of the printing quality, which occurs when the printing is performed with the initial ink, is often caused by the occurrence of the ink discharge failure including the unsuccessful ink discharge and the bending of the ink discharge direction due to the increase in the viscosity of the initial ink and the gas entered into the initial ink as described above. If the amount of the gas entered into the initial ink is large and the degree of the increase in the viscosity of the initial ink is high, it is impossible to dissolve the deterioration of the printing quality even when the purge process, in which the ink discharge amount is small, is executed.

Therefore, when the printing quality is deteriorated in the state in which the initial ink remains, if the same operation as the operation to be performed after the exhaustion of the initial ink is performed, i.e., if the purge process, in which the ink discharge amount is large next to that of the previous purge process, is executed when the weak purge is firstly executed and the purge request is continuously inputted while the deterioration of the printing quality is not dissolved in the previous purge process, then the number of repetition of the purge processes is consequently increased, and the ink discharge amount is increased, because the deterioration of the printing quality cannot be dissolved by the purge process in which the ink discharge amount is small.

The degree of the increase in viscosity and the amount of the gas entered into the initial ink differ depending on, for example, the term and the degree or extent of the environmental change brought about until the ink-jet printer 1 is firstly used. Therefore, if the purge process, in which the ink discharge amount is large, is uniformly executed while the deterioration of the printing quality arises in the state in which the initial ink remains, a large amount of the initial ink is discharged even when the degree of the increase in viscosity of the initial ink and the amount of the gas entered into the initial ink are small, and the deterioration of the printing quality may be dissolved by executing the purge process in which the ink discharge amount is small. That is, the initial ink, which can be used for the printing, is uselessly discharged.

On the contrary, if the purge process, in which the ink discharge amount is small, is uniformly executed, it is feared that the deterioration of the printing quality is not dissolved when the degree of the increase in viscosity of the initial ink and the amount of the gas entered into the initial ink are large.

Further, the ink discharge amount is generally constant in the purge process which has been hitherto executed automatically, for example, when the ink cartridge is attached to the cartridge attachment section 5 and when the state, in which the ink is not discharged from the ink-jet head 4, is continued for a predetermined period of time. As described above, the amount of the gas entered into the initial ink and the degree of the increase in viscosity in the initial ink are changed depending on, for example, the term and the degree of the environmental change brought about until the ink-jet printer 1 is firstly used. Therefore, if the automatic purge process, in which the ink discharge amount is constant, is executed as described above during the period in which the initial ink remains after the power source is firstly turned on, it is feared that the initial ink is uselessly discharged and/or the deterioration of the printing quality is not dissolved in the same manner as described above.

Accordingly, in this embodiment, as described above, the purge process is not executed unless the request for the purge process is inputted from the buttons 16*a* to 16*c* during the period in which the initial ink detecting section 64 detects that the initial ink remains after the power source is firstly turned on as described above (S104: YES). The buttons 16*a* to 16*c* are allotted for the inputs of the strong purge, the middle purge, and the weak purge respectively (S105). Further, only when the type of the purge process is selected by operating the buttons 16*a* to 16*c* by the user (S106: YES), the selected purge process is executed (S107).

Accordingly, when the amount of the gas entered into the initial ink is small, the degree of the increase in viscosity in the initial ink are low, and the degree of the deterioration of the printing quality of the printed matter is not large so much, then the user selects the purge process in which the ink discharge amount is small, and thus the initial ink can be effectively utilized without unnecessarily discharging the initial ink.

On the contrary, when the amount of the gas entered into the initial ink is large, the degree of the increase in viscosity in the initial ink are high, and the degree of the deterioration of the printing quality of the printed matter is large, then the user selects the purge process in which the ink discharge amount is large, and thus the initial ink, into which the gas entered and/or in which the viscosity is increased, can be completely discharged. Accordingly, it is possible to dissolve the deterioration of the printing quality, and it is possible to realize the required printing quality.

On the other hand, the ink, which is contained in the ink-jet head 4, the subtank 3, and the tube 6 after the initial ink is exhausted, is the ink which is newly supplied from the ink cartridge C. Therefore, the amount of the gas entered into the ink is small and the degree of the increase in viscosity of the ink is small except for such a situation that the ink-jet printer 1 is left to stand for a long period of time without using the ink-jet printer 1.

Therefore, the deterioration of the printing quality, which is caused when the printing is performed by using the concerning ink, is often caused by the occurrence of the ink discharge failure due to, for example, the drying of the ink in the nozzle 25 and the adhesion of any foreign matter to the nozzle surface, irrelevant to the degree of the deterioration of the printing quality. The deterioration of the printing quality, which is caused as described above, can be dissolved by the purge process in which the ink discharge amount is small.

Therefore, if the type of the purge process is selected by the user even after the initial ink is exhausted in the same manner as in the case in which the initial ink remains, the purge, in which the ink discharge amount is large, may be selected highly possibly when the printing quality is greatly deteriorated, even if the deterioration of the printing quality results from, for example, the drying of the ink in the nozzle 25 or the adhesion of any foreign matter to the nozzle surface and the deterioration can be dissolved by the purge process in which the ink discharge amount is small. Therefore, the ink is uselessly discharged.

Accordingly, in this embodiment, the state is given (S108), in which only the purge process request can be inputted in accordance with the operation of the buttons 16*a* to 16*c* after the initial ink is exhausted (S104: NO). Further, if the purge process request is inputted in accordance with the operation of the buttons 16*a* to 16*c* (S109: YES), the weak purge, in which the ink discharge amount is the smallest, is firstly (S111: YES) executed (S112). If the deterioration of the printing quality is not dissolved by the previous purge process, and the purge process request is further inputted (S111: NO), then the purge process, in which the ink discharge amount is large next to that of the previous purge process, is executed (S113). Accordingly, it is possible to avoid the useless discharge of the ink.

In this embodiment, the state is given, in which only the input of the purge process request can be inputted in accordance with the operation of the buttons 16*a* to 16*c* after the initial ink is exhausted. However, as the conventional purge process, which is to be automatically executed in a cycle, may be performed after the initial ink is exhausted. Further, a sensor which detects that the ink cartridge is attached to the cartridge attachment section 5 may be provided, and the purge process may be performed automatically irrelevant to the purge process request by the user, when the sensor detects that the ink cartridge is attached to the cartridge attachment section 5 after the initial ink is exhausted. Further, when the state, in which the ink is not discharged from the ink-jet head 4, is continued for a predetermined period of time, the purge process may be performed automatically irrelevant to the purge process request by the user.

Next, an explanation will be made about a modified embodiment in which various modifications are applied to the embodiment of the present invention. However, the components or parts, which are the same as or equivalent to those of the embodiment of the present invention, are designated by the same reference numerals, any explanation of which will be appropriately omitted.

Figure 6:
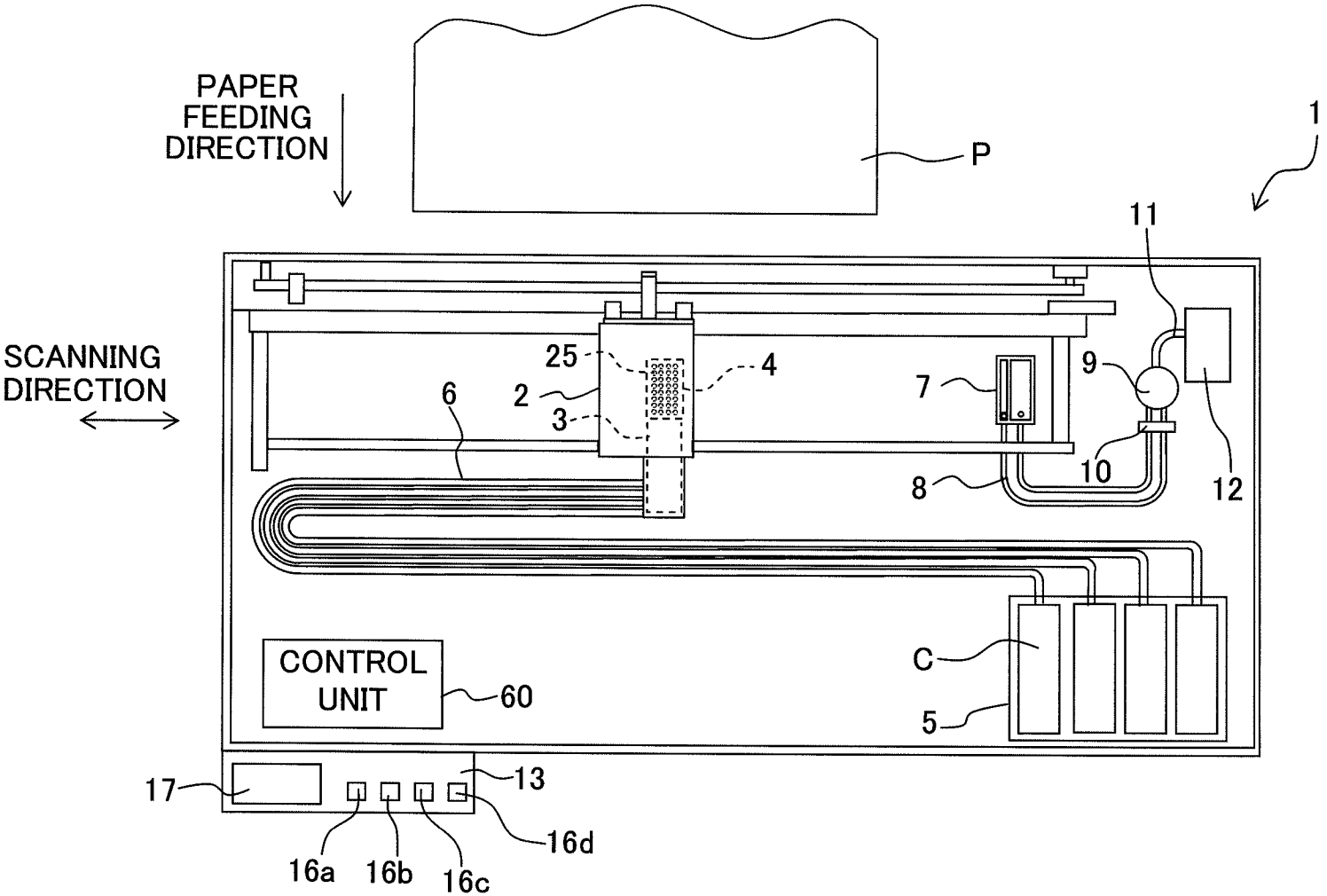
FIG. 6 shows a view in a modified embodiment corresponding to FIG. 1.
Figure 7A:
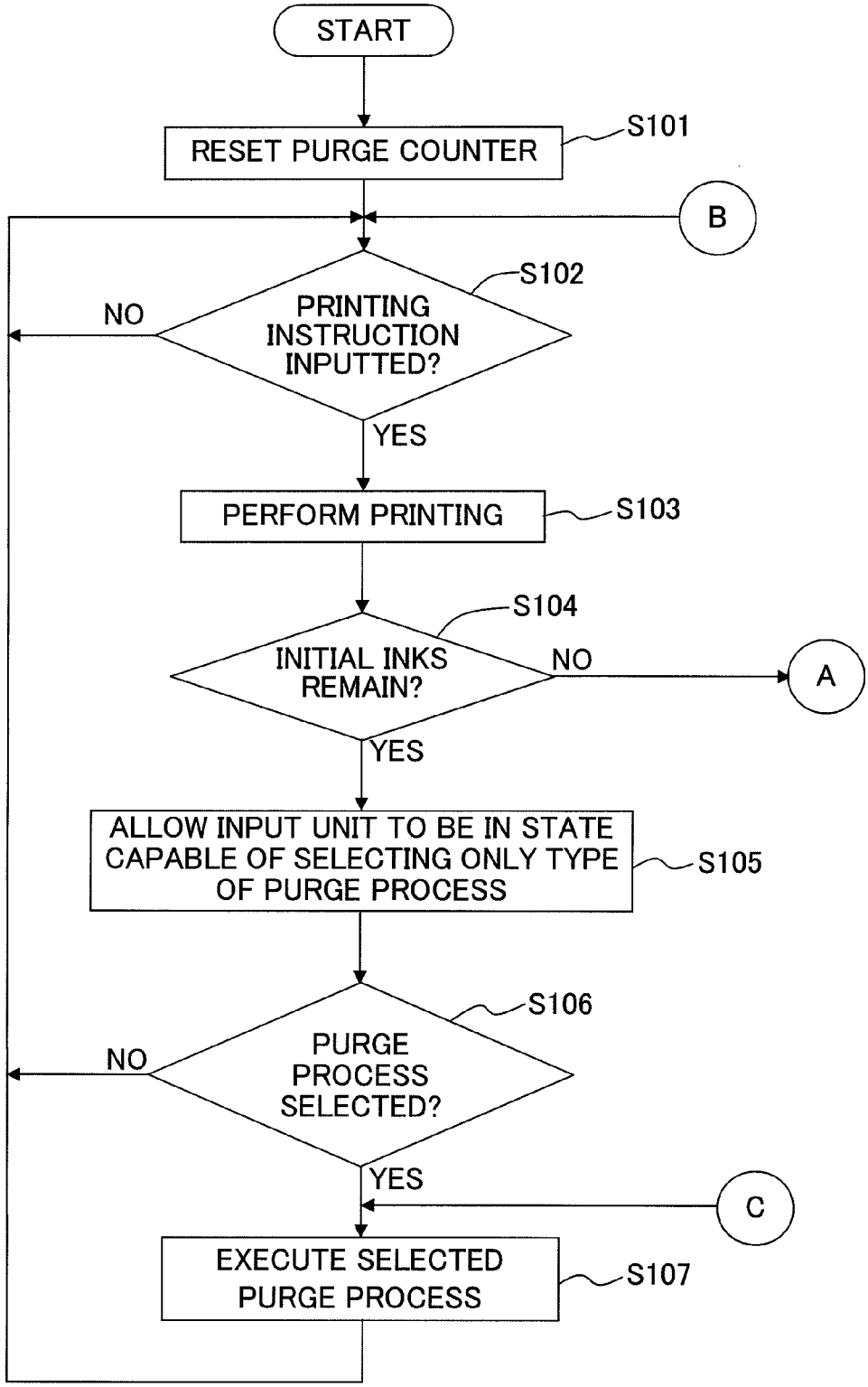
FIGS. 7A and 7B show a flow chart in the modified embodiment corresponding to FIG. 5.
Figure 7B:
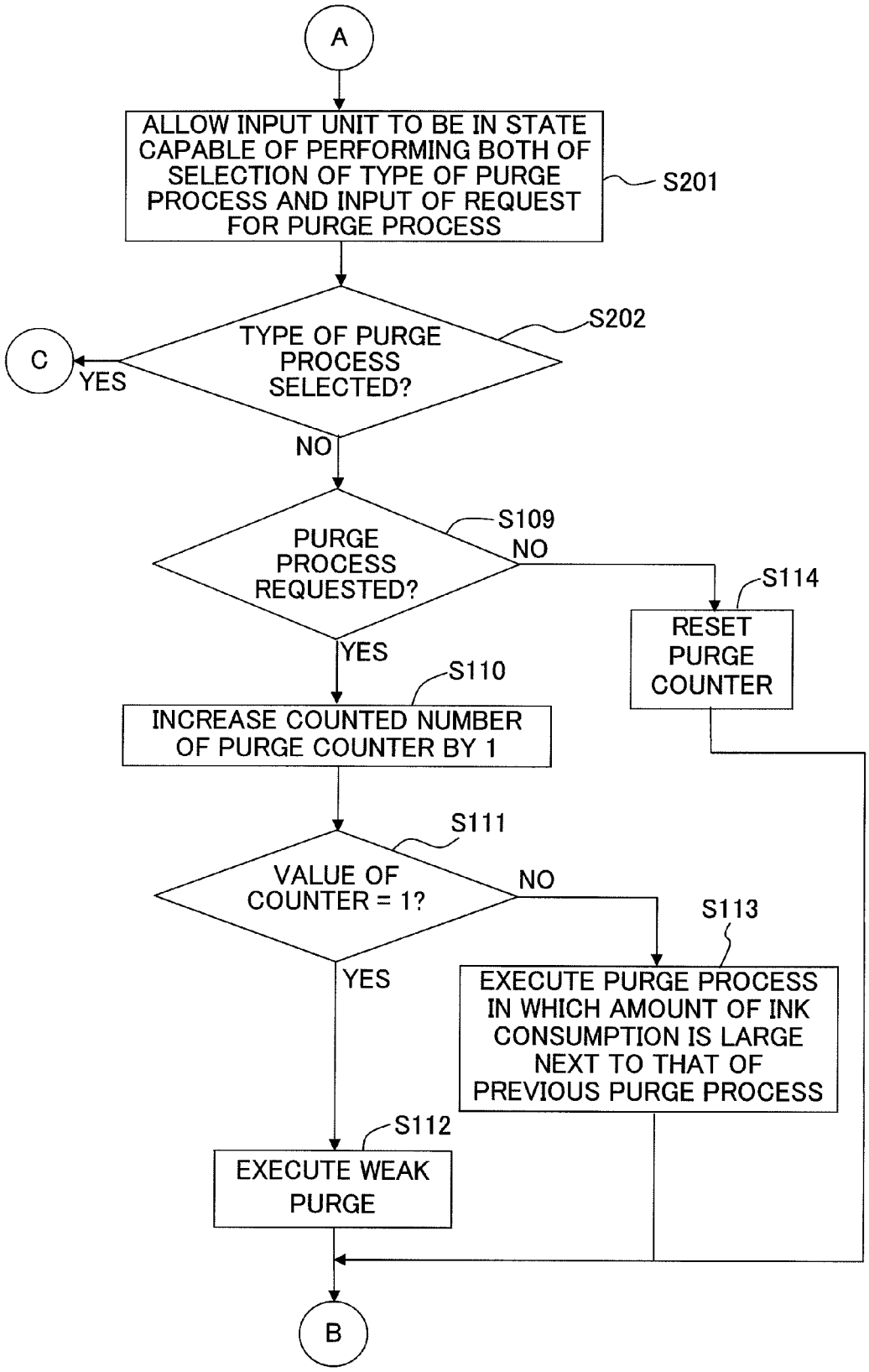

In one modified embodiment, as shown in FIG. 6, the input unit 13 is provided with a button 16*d* distinctly from the buttons 16*a* to 16*c*. As shown in FIG. 7, if the initial ink detecting section 64 detects that the initial inks do not remain (S104: NO), then the buttons 16*a* to 16*c* are continuously allotted for the inputs of the requests for the three types of purge processes described above, and the button 16*d* is allotted for the input of the purge process request in accordance with the control of the input unit control section 63 so that the allotment of the buttons 16*a* to 16*d* is displayed on the display 17 (S201). In this case, any function is not allotted to the button 16*d* in S105 described above.

That is, the input unit control section 63 controls the input unit 13 so that the input unit 13 can adopt only the first input form described above if the initial inks remain, and the input unit 13 can adopt both of the first form and the second form described above if the initial inks do not remain.

If any one of the three type of purge processes is selected in accordance with the operation of the buttons 16*a* to 16*c*, and the request for the concerning purge process is inputted (S202: YES), then the selected purge process is executed (S105) in the same manner as in the embodiment described above. On the other hand, if the purge process type is not selected (S202: NO), and the input of the purge process request is inputted in accordance with the operation of the button 16*d* (S109: YES), then the purge process is executed in accordance with the procedure of S110 to S113 described above in the same manner as in the embodiment described above.

The gas may enter the ink in some cases and the viscosity of the ink is increased in other cases, in the same manner as in the initial ink, when the ink-jet printer 1 is left to stand for a long period of time without using the ink-jet printer 1 even after the initial ink is exhausted and the ink, which is contained in the ink-jet head 4, the subtank 3, and the tube 6, is the ink which is newly supplied from the ink cartridge C. In such a situation, the deterioration of the printing quality is not dissolved by the purge process, in which the ink discharge amount is small, is executed.

In such a situation, if the purge process, in which the ink discharge amount is large next to that of the previous purge process, is executed in the same manner as in the embodiment described above when the weak purge is firstly executed uniformly and the deterioration of the printing quality is not dissolved by the previous purge process, then the number of repetition of the purge processes is increased and the ink discharge amount is increased as well, for example, when the amount of the gas entered into the ink and the degree of the increase in viscosity of the ink are high.

Accordingly, in this modified embodiment, the buttons 16*a* to 16*c* are allotted for the inputs of the requests for the three types of purge processes described above respectively after the initial inks are exhausted (S104: NO). Further, the button 16*d* is allotted for the input of the purge process request. Accordingly, it is possible to selectively perform any one of the input of the purge process request by selecting any one of the three types of purge processes described above and the input of the purge process request (S201).

If the user can estimate that the deterioration of the printing quality is caused by the ink discharge failure due to the increase in viscosity or the gas entered into the ink, for example, when the ink-jet printer 1 is left to stand for a long period of time without using the ink-jet printer 1, then the type of the purge process can be selected by operating any one of the buttons 16*a* to 16*c*, and the corresponding purge process can be executed. Therefore, it is possible to decrease the number of purge processes to be repeated until the deterioration of the printing quality is dissolved, and it is possible to avoid any useless discharge of the ink.

On the other hand, for example, when the period of time, in which the ink-jet printer 1 is not used, is short, the user can execute the purge process in accordance with the procedure of S110 to S113 described above in the same manner as described above by operating the button 16*d*. Accordingly, it is possible to avoid any useless discharge of the ink, which would be otherwise caused such that the purge process, in which the ink discharge amount is large, is executed when the printing quality is deteriorated, for example, due to the drying of the ink in the nozzle 25 and the adhesion of any foreign matter to the nozzle surface.

In the embodiment described above, when the input of the purge process request is inputted after the initial ink is exhausted, then the purge, in which the ink discharge amount is large, is executed as the number of the continuous inputs of the requests for the purge processes is more increased, while the deterioration of the printing quality is not dissolved by the previous purge process, as shown in S110 to S113 described above. However, the present invention is not limited thereto. For example, when the purge process request is given, it is also allowable to always execute the purge process in which the ink discharge amount is identical.

The embodiment described above is constructed such that the input of the purge process type and the input of the purge process request are inputted by operating the buttons 16*a* to 16*c* of the input unit 13 provided for the ink-jet printer 1 by the user. However, the present invention is not limited thereto. For example, the ink-jet printer 1 may be provided with a unit or device (input section) into which the signal of the purge process request or the like, which is the same as or equivalent to that of the embodiment described above, can be inputted from PC connected at the outside and which transmits, for example, to the purge control section 62, the signal to instruct the execution of the operation corresponding to the inputted signal, in place of the input unit 13.

The embodiment described above is constructed such that the three types of purge processes, in which the ink discharge amount mutually differs, can be executed in accordance with the control of the purge control section 62. However, it is also allowable to provide such a construction that two types or four or more types of purge processes, in which the ink discharge amount mutually differs, can be executed. Further, it is also allowable to provide such a construction that the purge process can be executed to clean out the initial inks from the ink supply flow passages and the ink-jet head in accordance with the selection by the user even when the initial inks remain.

Figure 8B:
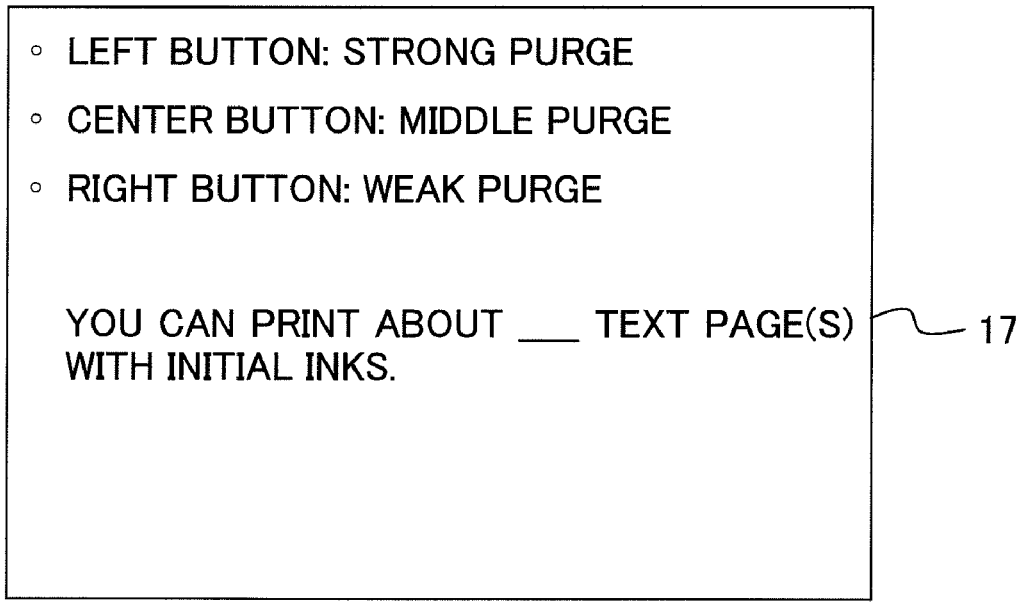
FIG. 8B shows an exemplary screen of a display according to the modified embodiment.

In the embodiment described above, if it is detected that the initial ink remains, then the buttons 16*a* to 16*c* are allotted for the inputs of the requests for the strong purge, the middle purge, and the small purge respectively in accordance with the control of the input unit control section 63, and the allotment of the buttons 16*a* to 16*c* is displayed on the display 17. However, the information, which is to be displayed on the display 17, is not limited thereto. For example, as shown in FIG. 8B, it is also allowable to display the information about the number of pages or sheets capable of being subjected to the printing with the remaining initial inks on the display 17 based on the ink remaining amounts detected by the initial ink detecting section 64, in addition to the allotment of the buttons 16*a* to 16*c* described above. In this case, the initial ink detecting section 64 may detect remaining amount of the initial inks based on total volume of the ink-jet head 4, the subtanks 3, and the tubes 6 and discharged amount of the initial inks. Further, the control unit 60 may include a calculating section which calculates the number of sheets capable of being printed by using the remaining initial inks based on the remaining amount of the initial inks.

In the embodiment described above, the initial ink detecting section 64 detects whether or not the initial inks remain in the ink-jet head 4, the subtanks 3, and the tubes 6. However, the initial ink detecting section 64 may detect whether or not the initial inks remain only in the ink-jet head 4 which is arranged at downstream side of the ink-flow with respect to the subtanks 3 and the tubes 6. In this case, a user can select whether or not the initial ink is to be used for printing until the initial ink in the ink-jet head 4 is completely used.

In the embodiment described above, when the purge process request or the purge process type is inputted by the user, the purge control section 62 executes the purge process with respect to all the four colors of inks of black, yellow, cyan, and magenta in the ink-jet head 4, subtanks 3, and the tubes 6. However, it may be possible that the user can select the colors of inks to be discharged by the purge process. In this case, when the user selects three colors of inks of yellow, cyan, and magenta to be discharged by the purge process based on a result of color printing, the initial ink of black is not discharged by the purge process and remains in the ink-jet head 4. Accordingly, after the purge process, text printing can be performed by using the initial ink of black.

Further, when the printing instruction is inputted into the printing control section 61, printing data is inputted into the printing control section 61 together with the printing instruction. In this case, the printing control section 61 may calculate ink amount, which is required for printing the printing data, based on information about image quality of the printing data. When the image quality of the printing data is high and the calculated ink amount is greater than remaining amount of the initial ink, the control unit may control the input unit 13 so that the input unit 13 can accept the input of the purge process request.

The foregoing description is illustrative of the exemplary case in which the present invention is applied to the ink-jet printer having the so-called serial head which discharges the inks while being reciprocatively moved in the scanning direction together with the carriage. However, the present invention is not limited thereto. The present invention is also applicable to an ink-jet printer having a so-called line head which is fixed to the ink-jet printer and which extends over the entire length of the width of the recording paper P.

What is claimed is:

1. An ink-jet printer provided with an ink-jet head which discharges an ink from a plurality of nozzles and an ink supply passage which is connected to the ink-jet head and through which the ink is supplied to the ink-jet head, the ink-jet head and the ink supply passage being filled with an initial ink, which is of a same type as that of the ink to be discharged from the nozzles, upon shipping of the ink-jet printer, the ink-jet printer comprising:

a purge mechanism which executes a purge process to forcibly discharge the ink in the ink-jet head and the ink supply passage from the nozzles;

an input section which accepts an input with respect to the purge process from a user;

an initial ink detecting section which detects whether or not the initial ink remains in the ink-jet head and the ink supply passage; and a controller which controls the purge mechanism and the input section based on a detection result of the initial ink detecting section;

wherein when the initial ink detecting section detects that the initial ink remains at least in the ink-jet head, the controller controls the input section to accept an input of a purge process type selected from a plurality of purge process types in which ink discharge amounts are different from each other; and wherein, after the initial ink detecting section detects that the initial ink does not remain in the ink-jet head and the ink supply passage, the controller controls the input section not to accept the input of the purge process type, and to accept an input of a purge process request.

2. The ink-jet printer according to claim 1;

wherein when the initial ink detecting section detects that the initial ink remains at least in the ink-jet head, the controller controls the purge mechanism to execute a purge process which is of the purge process type accepted by the input section; and wherein, after the initial ink detecting section detects that the initial ink does not remain in the ink-jet head and the ink supply passage, the controller controls the purge mechanism to execute a predetermined purge process.

3. An ink-jet printer provided with an ink-jet head which discharges an ink from a plurality of nozzles and an ink supply passage which is connected to the ink-jet head and through which the ink is supplied to the ink-jet head, the ink-jet head and the ink supply passage being filled with an initial ink, which is of a same type as that of the ink to be discharged from the nozzles, upon shipping of the ink-jet printer, the ink-jet printer comprising:

a purge mechanism which executes a purge process to forcibly discharge the ink in the ink-jet head and the ink supply passage from the nozzles;

an input section which accepts an input with respect to the purge process from a user;

an initial ink detecting section which detects whether or not the initial ink remains in the ink-jet head and the ink supply passage; and a controller which controls the purge mechanism and the input section based on a detection result of the initial ink detecting section;

wherein when the initial ink detecting section detects that the initial ink remains at least in the ink-jet head, the controller controls the purge mechanism to execute the purge process only when the input section accepts the input from the user.

4. The ink-jet printer according to claim 3;

wherein after the initial ink detecting section detects that the initial ink does not remain in the ink-jet head and the ink supply passage, the controller controls the purge mechanism to execute the purge process periodically.

5. The ink-jet printer according to claim 2, further comprising:

a cartridge attachment section to which an ink cartridge is attached, the ink cartridge storing the ink to be supplied to the ink-jet head and the ink supply passage;

wherein, when the ink cartridge is attached to the cartridge attachment section after the initial ink detecting section detects that the initial ink does not remain in the ink-jet head and the ink supply passage, the controller controls the purge mechanism to execute the predetermined purge process.

6. The ink-jet printer according to claim 1;

wherein, after the initial ink detecting section detects that the initial ink does not remain in the ink-jet head and the ink supply passage, and if the input section accepts the input of the purge process request for a plurality of times during a predetermined time period, the controller controls the purge mechanism to execute the purge process as a plurality of purge processes so that an ink discharge amount of a first purge process, among the plurality of purge processes, is greater than that of a second purge process which is executed before the first purge process.

7. An ink-jet printer provided with an ink-jet head which discharges an ink from a plurality of nozzles and an ink supply passage which is connected to the ink-jet head and through which the ink is supplied to the ink-jet head, the ink-jet head and the ink supply passage being filled with an initial ink, which is of a same type as that of the ink to be discharged from the nozzles, upon shipping of the ink-jet printer the ink-jet printer comprising:

a purge mechanism which executes a purge process to forcibly discharge the ink in the ink-jet head and the ink supply passage from the nozzles;

an input section which accepts an input with respect to the purge process from a user;

an initial ink detecting section which detects whether or not the initial ink remains in the ink-jet head and the ink supply passage;

a controller which controls the purge mechanism and the input section based on a detection result of the initial ink detecting section; and a display;

wherein, when the initial ink, detecting section detects that the initial ink remains at least in the ink-jet head, the controller controls the display to display an information about the purge process.

8. The ink-jet printer according to claim 7;

wherein the initial ink detecting section detects remaining amount of the initial ink remaining at least in the ink-jet head;

wherein the ink-jet printer further includes a calculating section which calculates the number of sheets to be printed by using the initial ink remaining at least in the ink-jet head based on the remaining amount of the initial ink detected by the initial ink detecting section; and wherein the controller controls the display to display the number of sheets calculated by the calculating section.

* * * * *